United States Patent [19]

Pfaffendorf

[11] 4,108,349

[45] Aug. 22, 1978

[54] SPACE DIVIDER FOR CARTONS AND THE LIKE

[75] Inventor: James L. Pfaffendorf, Maple Grove, Minn.

[73] Assignee: Boise Cascade Corporation, Boise, Id.

[21] Appl. No.: 851,719

[22] Filed: Nov. 15, 1977

[51] Int. Cl.[2] ..... B65D 5/48

[52] U.S. Cl. ..... 229/15

[58] Field of Search ..... 229/15

[56] References Cited

U.S. PATENT DOCUMENTS

| | | | |
|---|---|---|---|
| 1,812,126 | 6/1931 | Walker | 229/15 |
| 1,999,909 | 4/1935 | Lupton | 229/15 |
| 2,006,822 | 7/1935 | Andrews | 229/15 |
| 2,745,587 | 5/1956 | Vandenluft | 229/15 |
| 3,058,643 | 10/1962 | Wilson | 229/15 |

*Primary Examiner*—Davis T. Moorhead

*Attorney, Agent, or Firm*—Lawrence E. Laubscher

[57] ABSTRACT

A cellular space divider for cartons and the like is disclosed that is formed from a blank of sheet material such as corrugated cardboard. The blank contains vertical first scorelines that define front, rear, and a pair of side panels. One of the panels contains a horizontal first fold line, and the remaining panels each contain throughout substantially the length thereof a first cut colinear with the first fold line, whereby the panels are divided into lower first and upper second panel sections. When the panels are folded about the first score lines to define a tube and the adjacent ends of the panels are connected together, the lower and upper panel sections define lower and upper cell units, respectively, the upper cell unit being foldable about the first fold line to a position in which the external surfaces of the panel sections joined by the first fold line are in contiguous engagement, thereby to define a multi-cell arrangement. Another panel may be provided with a horizontal second fold line at a higher elevation than the first fold line, the remaining panels being provided with second cuts colinear with the second fold line, thereby to define a third cell unit that is foldable about the second fold line to a position in which the external surfaces of the panel sections on opposite sides of the second fold line are in contiguous engagement. In one embodiment, the rear panel is unitary, and in a second embodiment, the rear panel includes a pair of rear panel sections that are connected at their free ends, a divider panel being provided that is connected with one rear panel section and is foldable to a position extending transversely across the tube.

10 Claims, 16 Drawing Figures

Fig.1
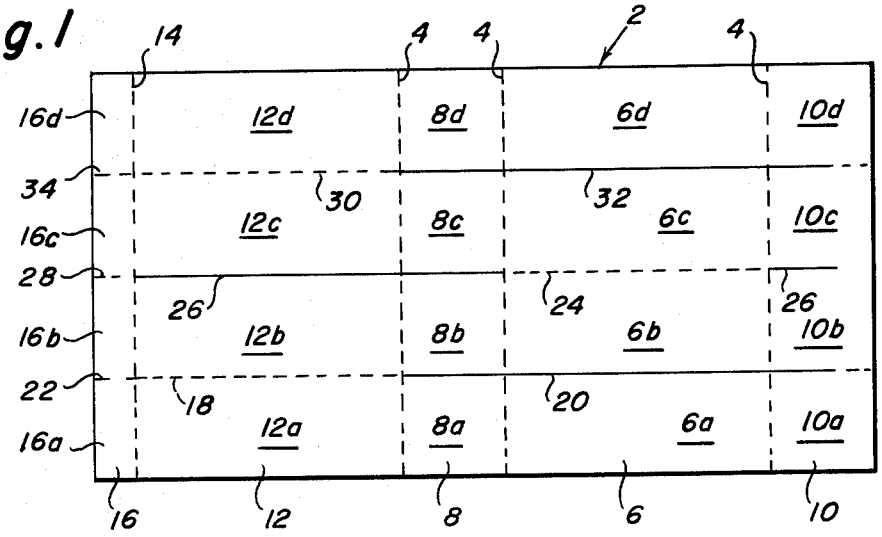
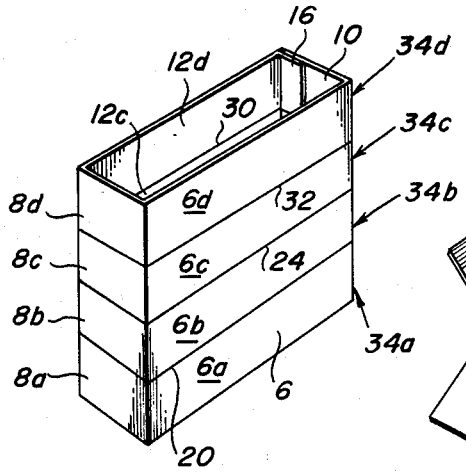
Fig.2
Fig.4
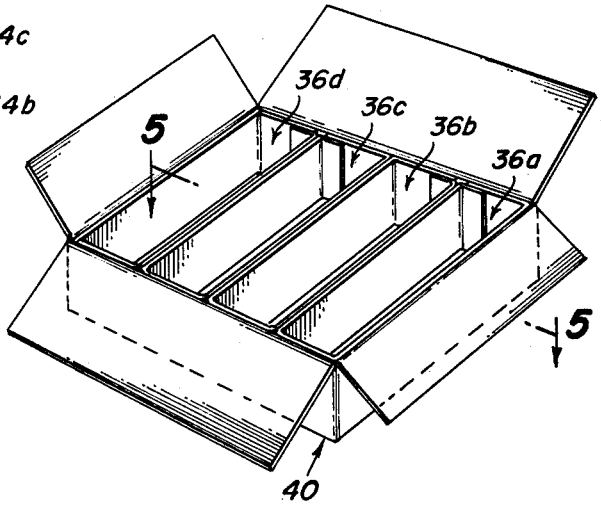
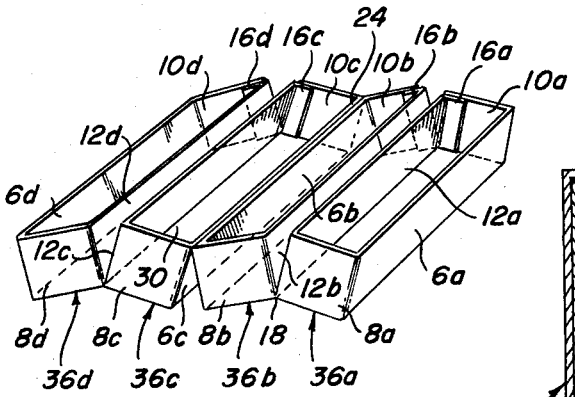
Fig.3
Fig.5
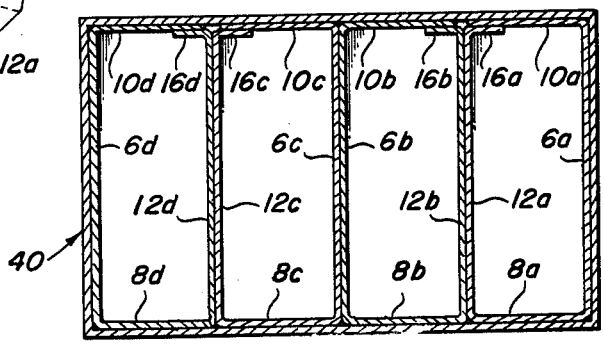

Fig.12
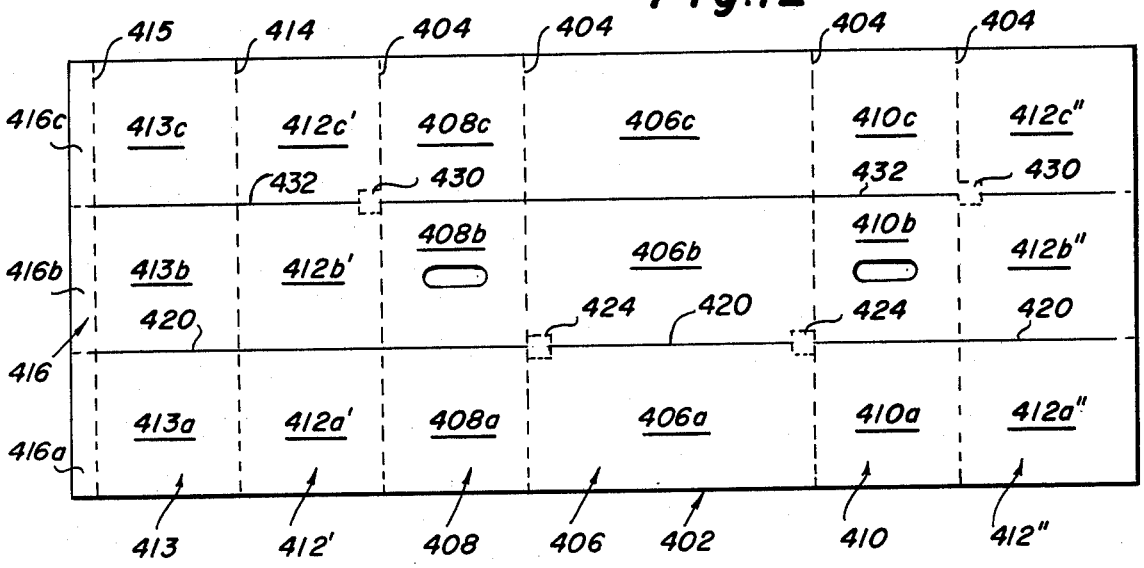
Fig.14
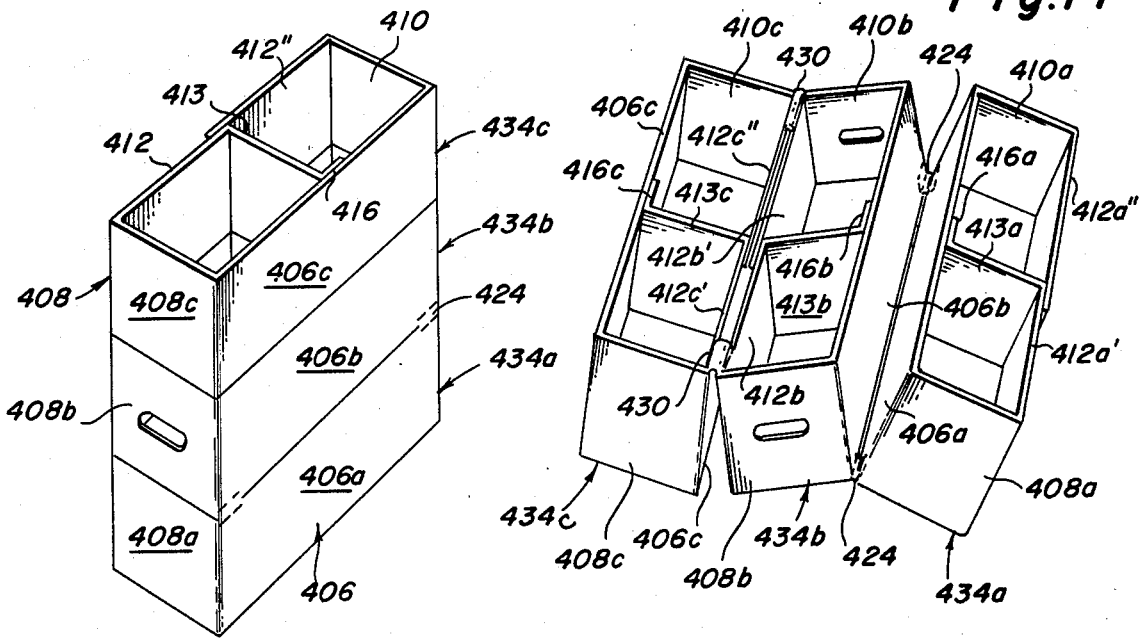
Fig.13
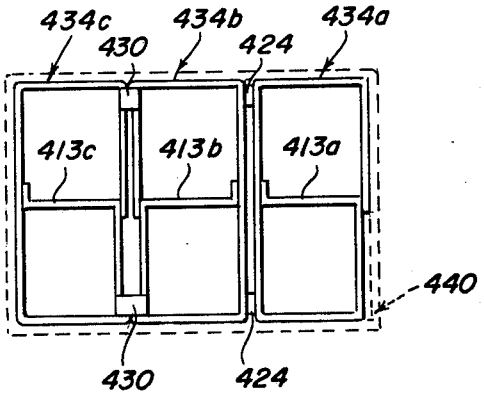
Fig.15

SPACE DIVIDER FOR CARTONS AND THE LIKE

BRIEF DESCRIPTION OF THE PRIOR ART

Various types of spaced dividers for cartons and the like have been disclosed in the patented prior art, which are formed from blanks of sheet material such as corrugated cardboard or the like, as evidenced, for example, by the patents to Nederveld No. 3,738,561, Wharton No. 3,871,569, and Hecks No. 3,985,286.

In general, the known dividers are of relatively complex construction requiring the provision of cooperating locking tab and slot means for effecting assembly, and are not designed to withstand relatively large loads parallel with the longitudinal axes of the cell chambers.

SUMMARY OF THE INVENTION

The present invention was developed to provide an improved multi-cell space divider that is readily assembled from a single blank of sheet material and which is designed to support appreciable load applied in a direction parallel with the longitudinal axes of the cell chambers.

Accordingly, a primary object of the present invention is to provide an improved multi-cell space divider that is formed from a single rectangular blank of sheet material containing vertical first score lines that define front, rear and a pair of opposed side panels, one of said panels containing means defining a horizontal first fold line, and the remaining panels each containing a horizontal first cut colinear with the first fold line, thereby to divide the panels into upper and lower panel sections. When the panels are folded about the first score lines to define a vertical tube of rectangular cross-sectional configuration and the free ends of the panels are connected together, the upper cell unit is foldable about the first fold line relative to the lower cell unit to a position in which the external surfaces of the panel sections joined by the first fold line are in contiguous engagement, thereby to define a multi-cell divider unit.

In accordance with a more specific object of the invention, another panel of the blank may contain a second fold line at a higher elevation than the first fold line, the remaining panels each containing a second cut colinear with the second fold line, whereby when the panels are folded to define the tube, a third cell unit is defined that is foldable about the second fold line to a position in which the external surfaces of the panel sections joined by the second fold line are in contiguous engagement. In like manner, a plurality of successive hingedly connected cell units may be formed from a single blank.

According to another object of the invention, the rear panel may comprise a pair of rear panel sections that are joined at their adjacent ends, a divider panel being connected with the free end of one rear panel section and being foldable to extend transversely of the tube between the front and rear panels, whereby each cell unit is divided into a pair of cells.

A further object of the invention is to provide a multi-cell divider unit of the type described above, in which a plurality of cell units are joined together by parallel hinge connections, the panel sections parallel with the hinge connections containing aligned bores for receiving an elongated object to be supported, such as a fluorescent lamp, for example.

The assemblied multi-cell space divider has a rectangular outer configuration to permit insertion within a carton, thereby to reinforce the carton and also to divide the same into a plurality of cells. Thus, the cartons, which are reinforced longitudinally of the cells, may be stacked to high heights, and if a carton should be stacked in overhanging relation or out of alignment in a pallet pattern, the weight weill be carried by the inner cells. The space divider may be used for protectively receiving individual objects such as fruit, or materials in bags or in bulk. The space divider adds wall strength for receiving bulk packs of dry eggs and other powdered goods.

BRIEF DESCRIPTION OF THE DRAWINGS

Other objects and advantages of the invention will become apparent from a study of the following specification when viewed in the light of the accompanying drawing, in which:

FIG. 1 is a plan view of a first embodiment of a blank for use in forming the cellular space divider means of the present invention;

FIGS. 2 and 3 are perspective views illustrating the intermediate assembly steps in forming the cellular divider means from the blank of FIG. 1;

FIG. 4 is a perspective view illustrating the assembled divider means mounted in a carton;

FIG. 5 is a sectional view taken along line 5—5 of FIG. 4;

FIG. 12 is a plan view of a second embodiment of a blank for forming the cellular divider means of the present invention;

FIGS. 13 and 14 are perspective views illustrating the assembly steps for forming the blank of FIG. 12 into the cellular divider means;

FIG. 15 is a top plan view illustrating the completed cellular divider mounted in a carton.

DETAILED DESCRIPTION

Figure 6:
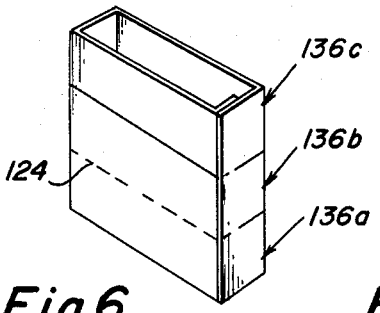
FIGS. 6 and 7, FIGS. 8 and 9, and FIGS. 10 and 11 are perspective and top diagrammatic views of various modifications of the space divider of FIGS. 1-5.
Figure 8:
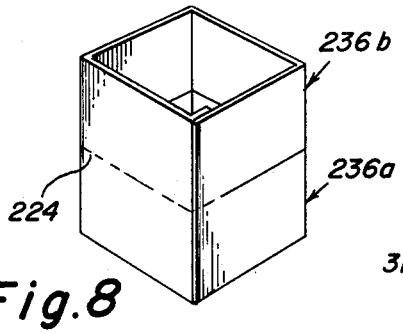

Referring first, more particularly to FIGS. 1-5, the multicell space divider of the present invention is formed from a rectangular blank 2 of a suitable sheet material. In the illustrated embodiment, the blank 2 is formed of corrugated cardboard, although other sheet materials such as paper board or a laminate of paper, foil, and/or a synthetic plastic material might be used as well. The blank 2 contains vertical first score lines 4 that define a front panel 6, a pair of side panels 8 and 10, and a rear panel 12. The blank 2 also contains a second score line 14 that defines a locking tab 16. As shown in FIG. 1, the rear panel 12 contains means defining a first line of fold 18, and the remaining panels contain a line of first cut 20 colinear with said first line of fold 18. As shown in FIG. 1, the cut 20 extends completely across the first side panel 8, completely across the front panel 6, and substantially completely across the second side panel 10, and a line of weakness 22 is formed in the locking tab 16 colinear with the first line of fold 18. Thus, the first line of fold 18 and the first line of cut 20 define in the blank 2 the panel sections *6a*, *8a*, *10a*, and *12a*, and the line of weakness 22 defines in the locking tab 16 the locking tab section *16a*. Similarly, the front panel 6 contains a second line of fold 24 at a higher elevation than the first line of fold 18, each of the remaining panels containing a second line of cut 26 that is arranged colinearly with respect to the second fold line 24 and which extends substantially completely thereacross. The locking tab 16 is provided with a line of weakness 28 colinear with the second line of fold 24. Thus, the second line of fold and the second cuts define in the blank the panel section 6*b*, 8*b*, 10*b*, and 12*b*, and the line of weakness 28 defines the tab section 16*b*. The rear panel 12 contains means 12 defining a horizontal third line of fold 30, and the remaining panels contain a third line of cut 32 colinear with the third line of fold 30, the locking tab 16 containing the colinear line of weakness 34. Thus, the blank 2 is further divided into the panel sections 6*c*, 6*d*, 8*c*, 8*d*, 10*c*, 10*d*, and 12*c*, 12*d*, and the locking tab 16 is divided into the sections 16*c* and 16*d*.

Figure 10:
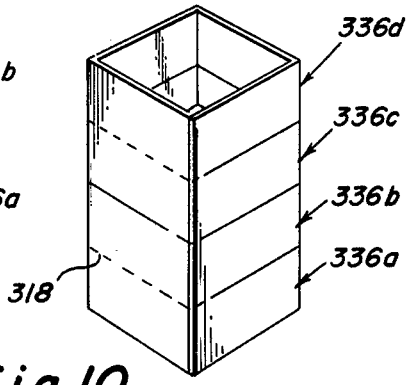
Figure 7:
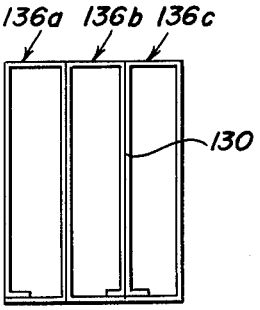
Figure 9:
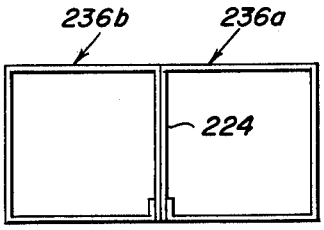
Figure 11:
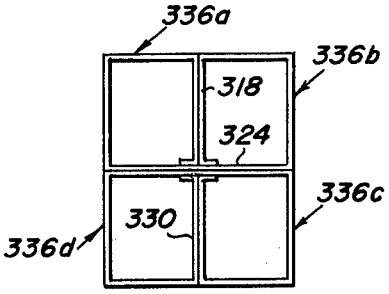

To assemble the multi-cell space divider from the blank 2, the panels are folded about the vertical score lines 4 into the configuration of a hollow tube of rectangular horizontal cross-section as shown in FIG. 2. The locking tab 16 is secured to the inner surface of the side wall 10 (for example, by means of a suitable adhesive). Referring now to FIG. 3, the hingedly connected cell units 36*a*, 36*b*, 36*c*, and 36*d* — that are hingedly connected together by the first, second, and third lines of fold 18, 24, and 30 — are folded about the fold lines to positions in which the outer surfaces of the panel sections joined by the fold lines are in contiguous surface engagement. Consequently, the assembly of cell units has a rectangular outer peripherial configuration to permit the cell assembly to be inserted within a carton 30 as shown in FIGS. 4 and 5. As is shown in FIG. 5, not only is the carton interior divided into a plurality of cells, but also the carton is reinforced in the vertical direction and both horizontal directions. Consequently, the resultant divided cartons are suitable for stacking to relatively high heights without the possibility of crushing or damaging the products contained therein. Referring to FIGS. 6–10, it will be apparent that various space divider cell configurations may be obtained depending on the number of cell units defined from the rectangular blank, and depending on those panels of the resultant tube that contain the lines of fold. For example, in the divider of FIGS. 6 and 7, three cell units 136*a*, 136*b*, and 136*c* are defined, the cell units 136*a* and 136*b* being hingedly connected by a line of fold 124 contained in the front panel, and the cell units 136*b* and 136*c* being hingedly connected by a horizontal line fold 130 contained in the rear panel. In the two-cell divider of FIGS. 8 and 9, the front panel contains a horizontal line of fold 224 about which the upper cell unit is pivoted to a position in which the external surfaces of the panel sections on opposite sides of the line of fold are in contiguous engagement as shown in FIG. 9. As shown in FIGS. 10 and 11, the lines of fold may be contained in various panels so that the cell units 336*a*, 336*b*, 336*c*, and 336*d* may be folded to define a square.

Referring now to the embodiment of FIG. 12, the blank 402 contains first vertical score lines 404 that define front panel 406, first side panel 408, second side panel 410, and a pair of rear panel sections 412' and 412'' that are connected with adjacent ends of the side wall panels 408 and 410, respectively. In this embodiment, a divider panel 413 is provided that is connected with the adjacent end of the rear panel section 412' by the second score line 414, a locking tab 416 being connected with the free end of the divider panel by the third score line 415. The front panel 406 contains means defining a horizontal first line of fold 424, the remaining panels containing first cuts 420 that are colinear with the first line of fold 424. In the illustrated embodiment, the fold defining means comprises a pair of hinges 424 that connect the front panel sections 406*a* and 406*b*. Similarly, the rear panel section 412' and 412'' contain horizontal fold defining means 430, the remaining panels containing second cuts 432 that are colinear with the second line of fold. As shown in FIG. 12, the fold defining means 430 defined in the rear panel sections 412' and 412'' are in the form of a pair of hinges.

In order to form the blank 402 into the multi-cell space divider, the panels are folded about the vertical score lines to the hollow tube configuration of FIG. 13, the overlapping edge of the rear panel section 412'' being adhesively secured to the adjacent external surface of the rear panel section 412', and the divider panel 13 extending transversely across the tube parallel with the side panels 408 and 410. The locking tab 416 at the free end of the divider panel is secured to the inner surface of the front panel 406. The cell units 434*a*, 434*b*, and 434*c* are pivoted about their respective hinge means 424 and 430 as shown in FIG. 14, whereupon the external surfaces of the panels connected by the hinge means are brought into contiguous surface engagement, whereupon the outer peripheral of the multi-cell space divider has a rectangular configuration for insertion within a carton 440 as shown in FIG. 15. It will be apparent that owing to the provision of the transverse divider panels 413*a*, 413*b*, and 413*c*, each cell unit is divided into a pair of cell chambers.

Figure 16:
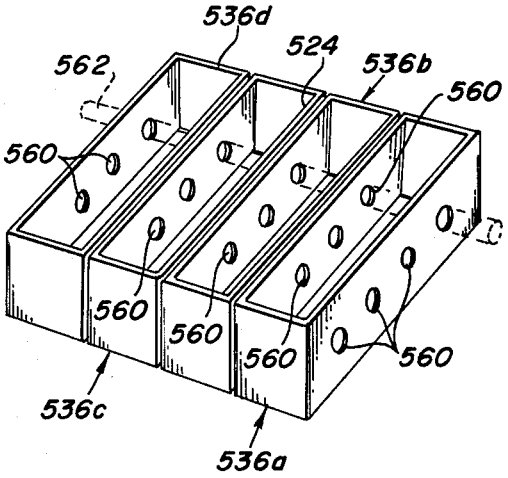
FIG. 16 illustrates the manner in which the divider means of FIGS. 1-5 may be used as a support for fragile objects, such as fluorescent lights.

Referring now to FIG. 16, it will be seen that if those panels of the cell units that are arranged parallel with the lines of fold are provided with a plurality of aligned apertures 560, the multi-cell assembly may be used as a support for an object 562 (such as a fluorescent lamp) that is axially introduced through a series of aligned apertures contained in the panels.

While in accordance with the provisions of the Patent Statutes, the preferred forms and embodiments of the invention have been illustrated and described, it will be apparent to those skilled in the art that various changes may be made without deviating from the inventive concepts set forth above.

What is claimed is:

1. A space divider for cartons and the like, comprising (a) a rectangular planar blank of sheet material including vertical parallel spaced first score lines defining a front panel, first and second side panels, a pair of rear panel sections connected with the free ends of the first and second side panels, respectively, and a divider panel connected with the free end of one of said rear panel sections, the length of said divider panel being generally equal to the length of said side panels;

(b) one of said panels containing means defining a horizontal first line of fold, the remaining panels each containing throughout substantially the length thereof a linear first cut extending colinearly with respect to said first line of fold, whereby said panels are each divided into a lower first section and an upper second section;

(c) said front panel, first and second side panels, and rear panel sections being foldable about said first score line to define a tube of rectangular crosssectional configuration, said divider panel being foldable transversely across the tube to a position parallel with the side panels;

(d) means for connecting the adjacent free ends of said rear panel sections, whereby said first and second panel sections define in the tube first and second cell units, respectively, said divider panel dividing each cell unit into a pair of cells;

(e) said second cell unit being foldable about said first line of fold to a position in which the external surfaces of the first and second panel sections joined by said first line of fold are in contiguous engagement, thereby to define an open-ended multi-cell space divider the outer periphery of which has a rectangular crosssection.

2. A space divider as defined in claim 1, wherein said blank is formed of corrugated cardboard, and further wherein said means defining said first line of fold comprises a slit-score.

3. A space divider as defined in claim 1, wherein said rear panel comprises a pair of rear panel sections connected with the free ends of the first and second side panels by said first score lines, respectively, said connecting means comprising means for connecting the adjacent free ends of said rear panel sections when said panels are folded to define the tube.

4. A space divider as defined in claim 3, and further including a divider panel connected by a vertical second score line with the free end of one of said rear panel sections, the length of said divider panel being generally equal to the length of said side panels, said divider panel also containing a first cut colinear with said first fold line and extending the length thereof, said divider panel being foldable, when the remaining panels are folded to define a tube, transversely across the tube to a position parallel with the side panels, thereby to divide each cell unit into a pair of cells.

5. A space divider as defined in claim 1, and further including means connecting the free end of the divider panel with the inner surface of the front panel.

6. A space divider as defined in claim 5, wherein said connecting means includes a locking tab connected with the free end of said divider panel by a vertical third score line, said locking tab also containing a first cut colinear with said first fold line means.

7. A space divider as defined in claim 6, wherein a further panel other than said divider panel contains means defining a second horizontal line of fold at a higher elevation than said first line of fold, the remaining panels and said locking tab containing second lines of cut colinear with said second fold means, thereby to define a third cell unit which is foldable about said second fold means to a position in which the external surfaces of the panel sections connected by said second fold means are in contiguous engagement.

8. A space divider as defined in claim 7, wherein a panel other than said further panel and said divider panel contains means defining a third line of fold at a higher elevation than said second line of fold, the remaining panels and said locking tab containing third lines of cut colinear with said third line of fold, thereby to define a fourth cell unit that is foldable about said third fold means to a position in which the external surfaces of the panel sections joined by said third fold line are in contiguous engagement.

9. A space divider as defined in claim 1, wherein the panel sections joined by said first fold line means and the panel sections parallel thereto contain aligned through bores for receiving an object to be supported by said space divider.

10. A space divider as defined in claim 1, wherein said means defining said horizontal first line of fold comprises a pair of spaced hinge means.

* * * * *